US005641308A

United States Patent [19]

Bixler et al.

[11] Patent Number: 5,641,308

[45] Date of Patent: Jun. 24, 1997

[54] ELECTRICAL CONNECTOR

[75] Inventors: Craig Bixler, Elmhurst; Richard A. Nelson, Glen Ellyn, both of Ill.

[73] Assignee: Molex Incorporated, Lisle, Ill.

[21] Appl. No.: 431,237

[22] Filed: Apr. 28, 1995

[51] Int. Cl.[6] ..... H01R 19/00

[52] U.S. Cl. ..... 439/660; 439/924.1

[58] Field of Search ..... 438/108, 609, 438/634, 65, 660, 924.1

[56] References Cited

U.S. PATENT DOCUMENTS

| | | | |
|---|---|---|---|
| 3,407,378 | 10/1968 | Siders et al. | 439/38 |
| 5,221,212 | 6/1993 | Davis | 439/108 |
| 5,295,843 | 3/1994 | Davis et al. | 439/108 |

FOREIGN PATENT DOCUMENTS

| | | | |
|---|---|---|---|
| 0268441 | 5/1988 | European Pat. Off. | 439/108 |
| 313679 | 2/1991 | Japan . | |

*Primary Examiner*—Neil Abrams
*Assistant Examiner*—Eugene G. Byrd
*Attorney, Agent, or Firm*—Charles S. Cohen

[57] ABSTRACT

An electrical connector includes a dielectric housing having a forwardly projecting mating portion. A plurality of terminals are mounted on the housing with contact portions in a side-by-side array and exposed on the forwardly projecting mating portion for engagement by the contacts of the appropriate complementary mating connector. The forwardly projecting mating portion includes a section thereof extending rearwardly over the forward end of at least one but not all of the contact portions of the terminals such that the at least one contact portion is engageable by a respective one of the contacts of the mating connector after engagement of the other contact portions by their respective contacts.

9 Claims, 2 Drawing Sheets

ELECTRICAL CONNECTOR

FIELD OF THE INVENTION

This invention generally relates to the art of electrical connectors and, particularly, to a system for providing sequential engagement of the terminal contacts of the connector.

BACKGROUND OF THE INVENTION

Generally, a typical electrical connector includes some form of dielectric or insulative housing which mounts a plurality of conductive terminals. The terminals have contact portions which are engageable by the contacts of a complementary mating connector or other connecting device. In most instances, the contacts of the mating connectors all engage simultaneously during the mating procedure.

On the other hand, there are applications wherein it is desirable to have certain contacts of the mating connectors interengage before other contacts. This type of application often is called a "first make-last break" system. For instance, it may be desirable for the contacts of a ground circuit to engage prior to the contacts of a "hot" circuit to prevent electrical "arcing" between the hot or live contacts.

Heretofore, one system for providing a "first make-last break" ability in a connector has been to simply provide selected terminals with longer contact portions than other terminals. Therefore, the selected terminals will be engaged prior to the other terminals and will be disengaged after the other terminals. A problem with such systems is that different terminal configurations must be fabricated and maintained in inventory which, in turn, is not particularly cost effective.

Another system for providing a "first make-last break" ability in a connector has been to provide identical terminals but to stagger the insertion depth of the terminals during assembly so that the contact portions of selected terminals are engaged before and disengaged after the other terminals. A problem with these types of systems is that different assembly steps must be used in fabricating a single connector, or elaborate assembly machines must be used. Again, such systems are not particularly cost effective.

In at least one other system for providing a "first make-last break" ability, disclosed in Japanese Patent Publication No. 3-13679, the extreme front tip of one terminal is blocked or protected by plastic material of the connector housing, whereas the extreme front tip of one or more of the other terminals is not blocked. Therefore, the tip of the one terminal will be engaged before the tip of the other terminals. Problems with this type of system are that the tips of the metal terminals may cause stubbing and damage to the mating contacts. In addition, full contact forces are not established immediately upon initial engagement with the exposed terminal tips which could affect the function of the first make-last break contacts. In essence, the control of the contact points with these types of systems is governed by the shape of the contacts, whereas the present invention provides control of the contact points by the location of the plastic material of the housing, which is typically easier to control.

The present invention is directed to solving the problems discussed above by providing a simple electrical connector which can utilize identical terminals yet afford a "first make-last break" ability in the connector.

SUMMARY OF THE INVENTION

An object, therefore, of the invention is to provide a new and improved electrical connector of the character described above.

In the exemplary embodiment of the invention, the electrical connector includes a dielectric housing having a forwardly projecting mating portion. A plurality of terminals are mounted on the housing with contact portions in a side-by-side array and exposed on the forwardly projecting mating portion for engagement by the contacts of an appropriate complementary mating connector. The invention contemplates that the forwardly projecting mating portion of the housing include a section thereof extending rearwardly over the forward end of at least one but not all of the contact portions of the terminals. In this manner, the at least one contact portion is engageable by a respective one of the contacts of the mating connector after engagement of the other contact portions by their respective contacts. The rearwardly extending section may be an integrally molded portion of the housing.

As disclosed herein, the contact portions of the terminals comprise flat blades which are disposed in channels in the forwardly projecting mating portion of the housing. The rearwardly extending section of the mating portion is adapted to close the channel over the forward end of the at least one contact portion. Still further, the contact portions of the terminals herein include tips which are disposed in cavities at the forward ends of the channels in the forwardly projecting mating portion of the housing. The rearwardly extending section of the mating portion is adapted to cover the forward end of the at least one contact portion behind the tip thereof.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
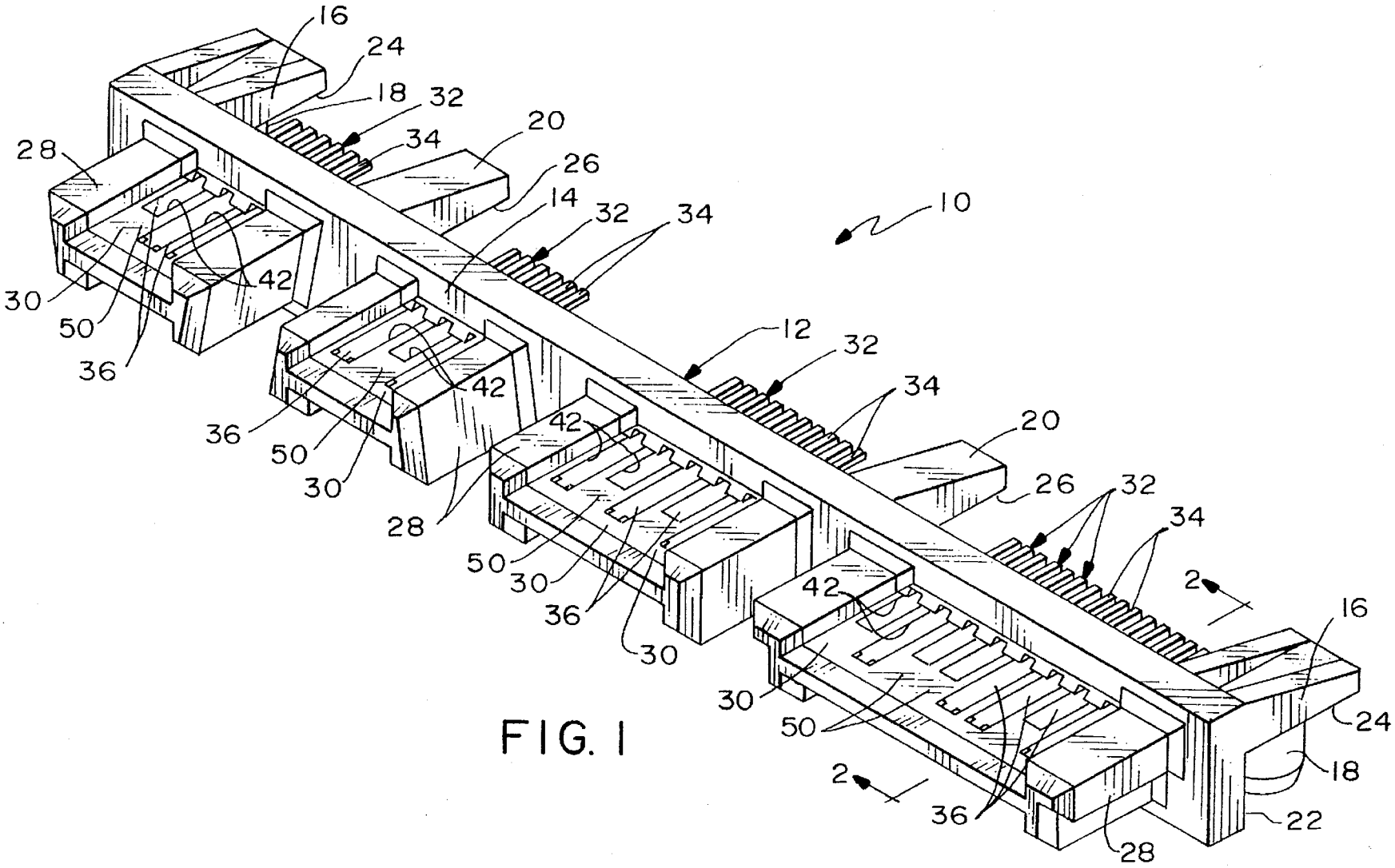
FIG. 1 is a front perspective view of an electrical connector incorporating the "first make-last break" system of the invention.

Referring to the drawings in greater detail, the invention is incorporated in an electrical connector, generally designated 10, which includes an elongated dielectric housing, generally designated 12. The housing includes an elongated flange or body portion 14 extending between a pair of end mounting portions 16 having depending mounting pegs 18 for insertion into appropriate mounting holes in a printed circuit board (not shown). The mounting portions project rearwardly of elongated flange 14, and three support ears 20 are spaced between the mounting portions and also project rearwardly of elongated flange 14. The connector is configured for mounting to an edge of the printed circuit board, with the edge of the board engaging a rear face 22 of elongated flange 14, while bottom surfaces 24 of mounting portions 16 and bottom surfaces 26 of support ears 20 engage the top surface of the board.

A plurality of discrete mating portions 28 are spaced along flange 14 and project forwardly therefrom. Each mating portion includes an intermediate wall 30 which defines top and bottom surfaces thereof. The entire dielectric housing 12, including elongated flange or body portion 14, mounting portions 16 and mounting pegs 18, support ears 20 and mating portions 28, is unitarily molded of plastic material or the like.

A plurality of terminals, generally designated 32, are mounted on dielectric housing 12 and extend through elongated flange 14. The terminals include surface mount solder tail portions 34 projecting rearwardly of flange 14 for surface connection to appropriate circuit traces on the top surface of the printed circuit board. As is generally desirable with surface mount connectors, all of the tail portions are in a line or row generally parallel to the longitudinal axis of housing 12 and perpendicular to the longitudinal axes of the individual terminals. The terminals also have blade-like contact portions 36 projecting forwardly of elongated flange 14. Generally, the contact portions are arranged in side-by-side parallel arrays on each forwardly projecting mating portion 28. The contact portions of one-half of the terminals are exposed on the top surface of wall 30 of the respective mating portion 28, and the contact portions of the other one-half of the terminals are exposed on the bottom surface of wall 30 of the respective mating portion.

Figure 2:
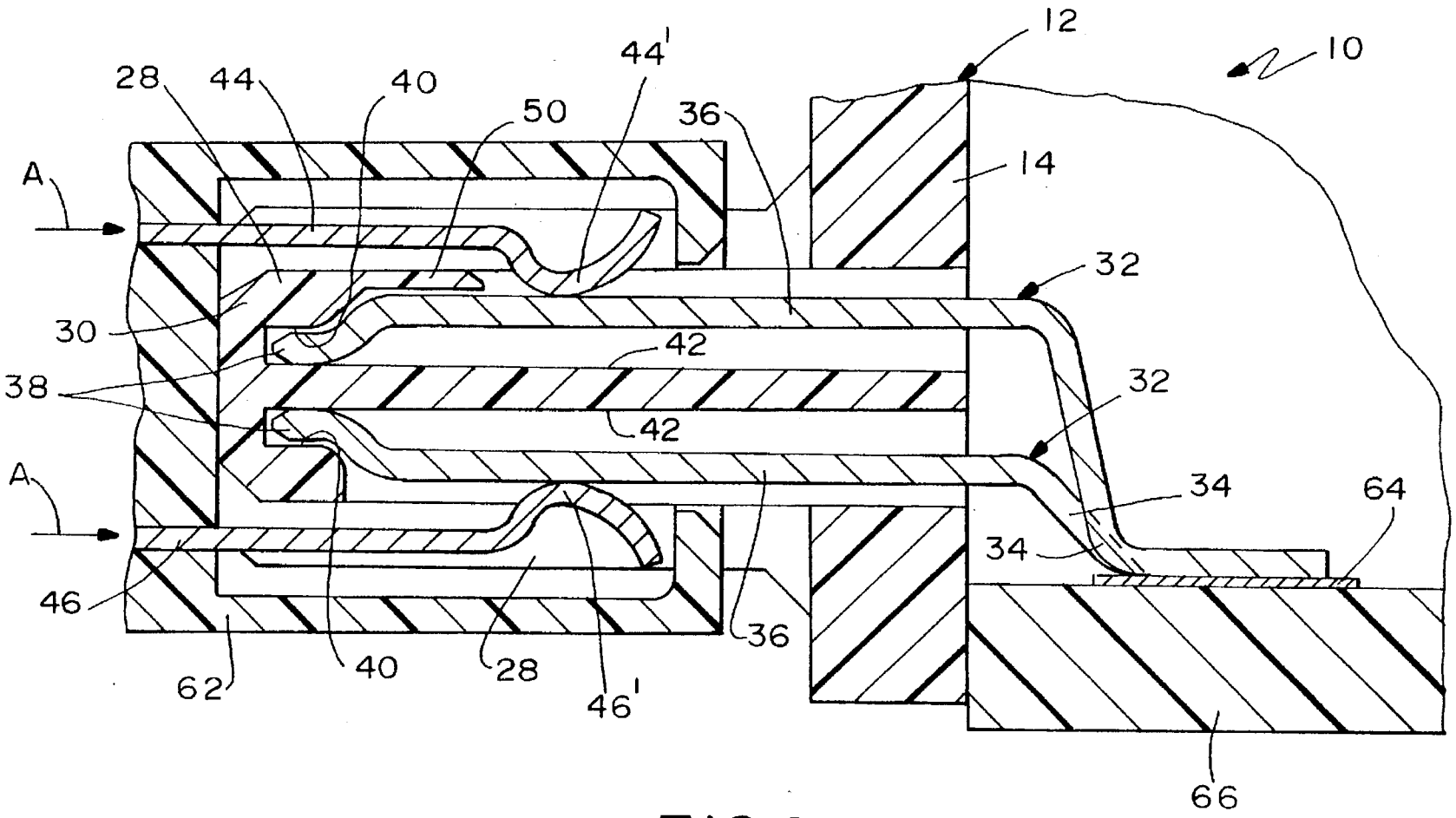
FIG. 2 is a fragmented vertical section, on an enlarged scale, taken generally along line 2—2 of FIG. 1, shown in conjunction with a pair of contacts of a complementary mating connector (not shown).

Referring to FIG. 2 in conjunction with FIG. 1, the invention contemplates that all of terminals 32 can be fabricated of substantially identical configuration if desired. At least the forwardly projecting contact blades 36 can be of equal length as seen clearly in FIG. 2. In the preferred embodiment of the invention, the contact blades have offset tips 38 which project into cavities 40 of the dielectric material of the respective mating portion 28. The contact blades are disposed within channels 42 in the top and bottom surfaces of wall 30, with cavities 40 being located at the extreme front ends of the channels. FIG. 2 also shows a top contact 44 and a bottom contact 46 of an appropriate complementary mating connector 62 or other connecting device in engagement with the top and bottom contact blades 36 of terminals 32.

Still further, it can be understood from FIG. 2 that the normal contact forces between contact portion 44' of top contact 44 with the top contact blade 36 and the normal forces of contact portions 46' of bottom contact 46 with the bottom contact blade 36 will remain equal and constant from the initial engagement of the contacts to the full engagement shown. In other words, the force exerted by contact portion 46' on bottom contact blade 36 will remain constant from the time of its initial contact after it passes over the lower rear edge **28*a* of mating portion 28 until it reaches the fully mated position shown in FIG. 2. Likewise, the force exerted by contact portion 44' on top contact blade 36 will remain constant from the time of its initial contact after it passes over the upper rear edge 50*a* of section 50 until it reaches the fully mated position shown in FIG. 2**.

In order to provide a "first make-last break" system in electrical connector 12, FIG. 2 best shows that a section 50 of mating portion 28 is molded to extend rearwardly over the forward end of the top contact blade 36 a predetermined distance behind tip 38 of the contact blade. Comparing the top contact blade with the bottom contact blade in FIG. 2, it can be seen that the bottom contact blade is not covered by a similar section 50. Therefore, when contacts 44 and 46 are moved simultaneously in the direction of arrows "A", during mating complementary connector 62 with connector 10, it readily can be understood that contact portion 46' of bottom contact 46 will engage the bottom contact blade 36 before contact portion 44' of top contact 44 will engage the top contact blade of the two terminals 32 shown. Consequently, bottom contact 46 and its respective bottom contact blade 36 would be a "first make-last break" pair of contacts in comparison to top contact 44 and its respective top contact blade 36. Regardless of the point of engagement between contact portion 44' of top contact 44 with its respective contact blade 36, and the point of engagement between contact portion 46' of bottom contact 46 with its respective contact blade 36, the normal forces between the respective pairs of contacts always will be the same, as stated above.

Referring back to FIG. 1, it can be seen that each mating portion 28 has at least one section 50 which is molded to extend rearwardly over the respective forward end of at least one of the contact blades 36 to cover the forward end of the contact blade. The number and location of the covering sections 50 in FIG. 1 is arbitrary, simply to facilitate the illustration. However, it readily can be understood how a "first make-last break" capability is provided simply by the manner in which housing 12 is molded, while maintaining all of the terminals with the same configuration. This system is very cost effective and permits an inventory of only a single terminal construction, the system does not require any multiple assembly steps to insert the terminals and all of the solder tails of the terminals are positioned in a line.

As stated above, the invention contemplates that all of terminals 32 can be fabricated of substantially identical configuration if desired. In particular, referring to FIG. 2, identical terminals can be fabricated and the connector assembled by inserting each contact blade 36 into housing 12 the same distance until tips 38 of the terminals seat within cavities 40 of the housing. The terminals simply are inverted relative to each other. Tail portions 34 then are bent and cut to appropriate lengths, after insertion, so that the tail portions are located in a line for solder engagement with circuit traces 64 (FIG. 2) on printed circuit board 66.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector comprising:

a one-piece dielectric housing having a flange from which a forwardly projecting mating portion extends, said mating portion having on opposite sides thereof a plurality of terminal receiving channels in a side-by-side array extending rearwardly from a leading region of said mating portion, a plurality of substantially identical terminals mounted on the housing, each said terminal including a contact portion in one of said channels and exposed on the forwardly projecting mating portion for engagement by a contact of an appropriate complementary mating connector and a tail portion for soldering to a circuit member, said forwardly projecting mating portion including at least one first section thereof and at least one second section thereof, each of said first and second sections extending rearwardly from a leading edge of said mating portion and over a forward end of a respective one of said terminal receiving channels, said at least one first section extending a different length from said leading edge than said at least one second section such that the at least one first section prevents said contact portion of said terminals aligned with said at least one first section from engaging a respective one of the contacts of the mating connector until after engagement of said contact portions of the terminals aligned with said at least one second section by respective contacts of the mating connector.

2. The electrical connector as set forth in claim 1 wherein said contact portions of the terminals comprise flat blades exposed on the outside of a wall of the forwardly projecting mating portion of the housing.

3. The electrical connector as set forth in claim 1 wherein said contact portions of the terminals include tips which are disposed in cavities in the leading region of the forwardly projecting mating portion of the housing, and said rearwardly extending section of the mating portion is adapted to cover the forward end of said at least one contact portion behind the tip thereof.

4. The electrical connector as set forth in claim 3 wherein each said terminal includes, in series, a tip portion, said contact portion, a retention portion for securing said terminal within said housing and a tail portion for interconnecting said terminal to a circuit board, each of said terminals being identical from said tip portion to said retention portion.

5. The electrical connector as set forth in claim 1 wherein each said terminal includes a surface mount tail portion for soldering to circuit traces on a circuit board.

6. An electrical connector, comprising:

a one-piece dielectric housing having an elongated body portion, and at least one discrete forwardly extending mating portion spaced along the body portion and projecting forwardly therefrom;

a plurality of substantially identical terminals mounted on the elongated body portion and each said discrete mating portion, each said terminal including a terminal tail projecting rearwardly of the body portion and a terminal contact blade projecting forwardly for engagement by a respective contact of an appropriate complementary mating connector, said terminal contact blades being exposed in a side-by-side array on opposite sides of the mating portion; and one of said at least one mating portions including a rearwardly extending section thereof extending rearwardly over a forward end of at least one but not all of the terminal contact blades thereon such that the at least one contact blade is engageable by a respective one of the contacts of the mating connector after engagement of the terminal contact blades of others of the terminals by respective contacts of the mating connector.

7. The electrical connector of claim 6 wherein said contact blades are disposed in channels in the at least one forwardly projecting mating portion of the housing and said rearwardly extending section is adapted to close the channel over the forward end of said at least one contact blade.

8. The electrical connector of claim 6 wherein said contact blades include tips which are disposed in cavities in the forwardly projecting mating portions of the housing, and said rearwardly extending section is adapted to cover the forward end of the at least one contact blade behind the tip thereof.

9. The electrical connector as set forth in claim 6 wherein each said terminal includes, in series, a tip portion, said contact blade, a retention portion for securing said terminal within said housing and a terminal tail for interconnecting said terminal to a circuit board, each of said terminals being identical from said tip portion to said retention portion.

* * * * *